United States Patent [19]

Bartelmuss

[11] 4,449,565

[45] May 22, 1984

[54] CONNECTING ARRANGEMENT FOR SUPPORT MEMBERS COOPERATING WITH A LIQUID PERMEABLE WEB

[76] Inventor: Heinrich Bartelmuss, No. 63, Steiermark, A 8833 Teufenbach, Austria

[21] Appl. No.: 188,033

[22] Filed: Sep. 17, 1980

Related U.S. Application Data

[63] Continuation of Ser. No. 48,078, Jun. 13, 1979, abandoned.

[51] Int. Cl.[3] ..... D21F 7/00

[52] U.S. Cl. ..... 162/352; 162/374

[58] Field of Search ..... 162/374, 352

[56] References Cited

U.S. PATENT DOCUMENTS 3,870,597 3/1975 Getman et al. ..... 162/352

4,184,915 1/1980 Metcalf ..... 162/352

FOREIGN PATENT DOCUMENTS 1958758 6/1971 Fed. Rep. of Germany ..... 162/352

*Primary Examiner*—William F. Smith

*Attorney, Agent, or Firm*—Karl F. Ross; Herbert Dubno

[57] ABSTRACT

A connecting arrangement for a hard-material plate, block or other member, serving as a support for a liquid-permeable web in a paper making or similar machine, in which the hard-material body, e.g. an oxide ceramic, receives a clip which also engages a rigid support for the body. According to the invention slots are formed in the hard-material body and are of circular-arc configuration whose inner radius is at least ½% smaller than the curvature of the free shanks of the clip engaging in the grooves.

7 Claims, 9 Drawing Figures

FIG.1
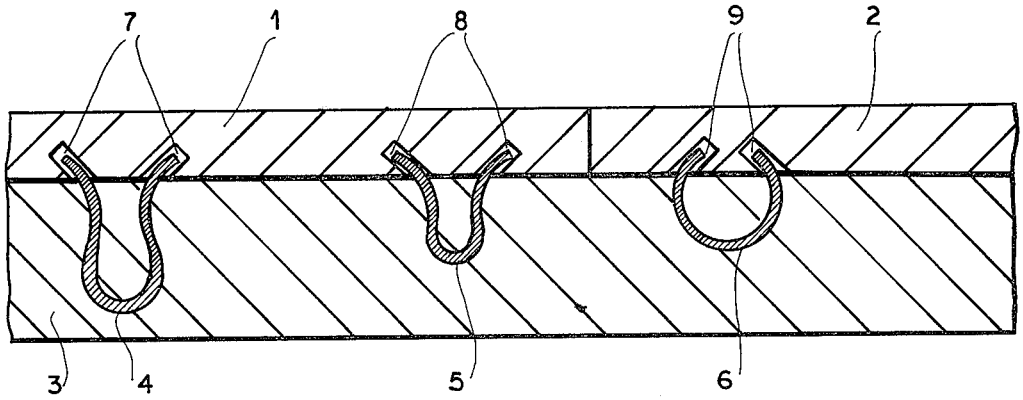
FIG.2
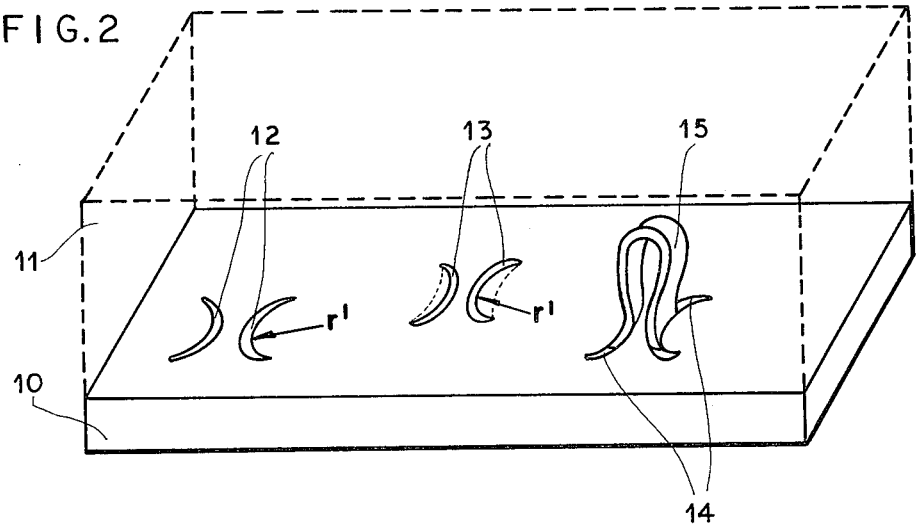
FIG.3
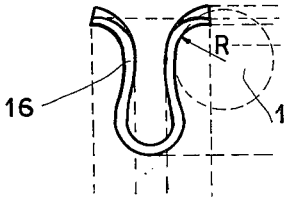
FIG.4
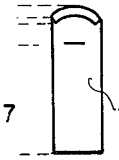
FIG.6
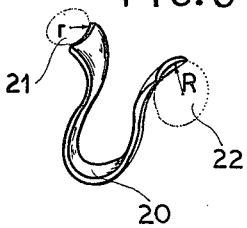
FIG.5
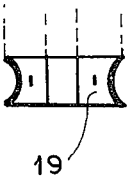
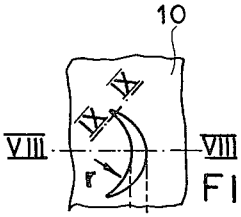
FIG.7
FIG.8
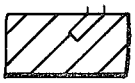
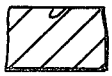
FIG.9

CONNECTING ARRANGEMENT FOR SUPPORT MEMBERS COOPERATING WITH A LIQUID PERMEABLE WEB

This is a continuation of application Ser. No. 048,078, filed June 13, 1979, abandoned.

CROSS REFERENCE TO RELATED APPLICATIONS

This application is related to my copending application Ser. No. 807,330, now U.S. Pat. No. 4,164,442, filed June 16, 1977 as a division of application Ser. No. 631,618, now U.S. Pat. No. 4,047,993, filed Nov. 13, 1975 which referred, in turn, to U.S. Pat. No. 3,067,818 and Austrian Pat. Nos. 279,334, 280,034, 280,035, 280,036 and 313,697. The application is also related to copending application Ser. No. 963,285 continuation filed on July 21, 1980, Ser. No. 170,655 in which reference has been made to U.S. Pat. No. 3,576,716, to Austrian Pat. Nos. 302,800 and 311,783 and to German Pat. No. 949,979.

FIELD OF THE INVENTION

My present invention relates to improvements in paper making and like machinery and, more particularly, to a connecting element between an abrasion resistant body and a support for machines in which the abrasion resistant body is to carry or guide a liquid-permeable layer upon which a pulpy mass is to be dewatered.

BACKGROUND OF THE INVENTION

In Fourdrinier and other paper-making, cellulose-dewatering and asbestos-cement plate machines, it is a common practice to apply and doctor a wet pulpy mass of material adapted to form a web or hardened layer onto a water-permeable layer which is moved across support bodies as part of a drainage system whereby the excess water is removed through the liquid-permeable layer.

Liquid-permeable layer can be a sieve, a screen, a foil, a fabric, a needled or nonwoven felt, or any other member which facilitates extraction of the excess liquid by suction or by gravity or both from the pulpy mass through interstices of the liquid-permeable layer.

The support bodies over which this liquid-permeable layer is displaced can be bars, plates, lips or edges of suction boxes, suction plates or the like.

As the afore-mentioned copending application indicate, it is advantageous to make at least those portions of the latter bodies which are juxtaposed with the sieve, this term being used herein to refer to the liquid permeable layer in the most generic manner, of a hard abrasion resistant material, e.g. an oxide-type ceramic. This hard material is generally harder than the material of the sieve and more wear resistant than the latter.

It has also been proposed heretofore to mount the body of the hard material upon a support which acts as a stiffening torsion-resistant member limiting relative transverse movement between the hard material and the sieve which tends to damage the hard-material body.

However, difficulties have been encountered heretofore in connecting the hard-material body with such rigid and stiff supports so that the hard-material body is practically immobilized on its support except for minor expansion and contraction differences.

OBJECTS OF THE INVENTION

It is the principal object of the present invention, therefore, to provide an improved assembly for joining a hard-material body to a support for use in machines of the type described.

Another object of the invention is to provide an improved connecting member for use in such an assembly.

SUMMARY OF THE INVENTION

These objects and others which will become apparent hereinafter, are attained in accordance with the present invention in an assembly which includes a ceramic oxide plate (sieve-support body) and a throughgoing support member for this ceramic plate which are bridged by connecting members in the form of U-shaped clips whose free ends or shanks are lodged in circular-arc grooves formed in one of the members and including angles of about 90° with one another, while a bight of each clip is lodged in the other member.

According to the invention, the free shanks of the spring-deformable clips are curved so as to be outwardly concave and with a curvature of circular-arc configuration such that the inner radius of each groove or slit is at least 0.5% smaller than the radius of the free shank of the spring clip receivable in the groove.

According to an important feature of the invention, the grooves are ground into the hard-material body and are so dimensioned with respect to the spring clip that the latter continuously exerts upon the hard-material body a force of at least 1 gram. The maximum pressure applied to the hard-material body by the spring characteristics of the clip should be 5% less than of the rupture strength of the body.

According to another feature of the invention, the free ends of the shanks of the spring clip lie along segments of an imaginary ball whose radius ranges from at least 3 mm to a maximum of 500 mm. The segment of the imaginary sphere formed by the free ends of the spring clips is cut straight along a cutting circle of a radius of at least 1 mm. The width of the spring clip should be at least 1 mm and at most 30 mm while the height for the purposes of the present invention should be at least 3 mm. It is important for the present invention that the free ends of the spring clips project by at least 2% of the length of the latter into the hard-material plates although not more than 25% of the length.

I have found that all of the dimensions given above, apart from those described hereinafter or previously as critical, are important for effective connection of the two members in the sense that dimensioning outside the indicated ranges do not preclude failure of the junction under normal use in high-speed paper-making and like machinery.

BRIEF DESCRIPTION OF THE DRAWING

The above and other objects, features and advantages of the present invention will become more readily apparent from the following description, reference being made to the accompanying drawing in which:

FIG. 1 is a cross section through an assembly according to the invention using several types of spring clips or clamping elements;

FIG. 2 is a diagrammatic perspective view showing the underside of a hard-material body and one spring clip in place;

FIG. 3 is an elevational view of a spring clip as used in the assembly of FIG. 2;

FIG. 4 is a side view of the latter spring clip;

FIG. 5 is a top view of this spring clip;

FIG. 6 is a perspective view of another spring clip;

FIG. 7 is a plan view of a section of a hard-material body provided with a groove for receiving such a spring clip;

FIG. 8 is a section along the line VIII—VIII of FIG. 7; and

FIG. 9 is a section along the line IX—IX of FIG. 7.

SPECIFIC DESCRIPTION

FIG. 1 shows a pair of hard-material plates 1 and 2, for example of an oxide ceramic as described in the aforementioned copending applications which lie side by side on a rigid hard throughgoing support 3, e.g. of steel, these members being held together by spring clips 4, 5 and 6 of U configuration.

The spring clips 4, 5 and 6 are completely enclosed within the resulting assembly. The bights of the spring clips 4 through 6, which are generally of U configuration (this term being inclusive of "C" shape and configurations resembling Ω) are fully embedded in the body 3, e.g. by being cast therein, by being set into recesses and potted therein, or by being inserted into suitably shaped recesses or grooves formed by machining therein.

The free ends of the shanks of the spring clips 4,5,6 project beyond the upper face of the support 3 and engage in grooves 7, 8, and 9 of the hard-material plates 1, 2 under stress against the edges of the grooves.

The grooves are ground into the oxide ceramic or other hard-material plates at an angle of about 90° between them for each spring clip so that each pair of grooves has a dovetail configuration.

The spring clips 15, 16, 18, 19 and 20 are received in the respective grooves 7 through 9, 12 through 14 that they press with their outer edges of the clip ends against the hard material with a force of at least 1 g but no more than 5% less than the rupture strength of the hard material.

FIG. 2 shows a hard-material plate 10 in which a number of bars of groove-like circular-arc recesses 12, 13 and 14 are formed at angles of 90° between the grooves of each bar.

The spring clip 14 is shown, already fitted into the grooves 14, while the throughgoing support body has been illustrated only in broken lines.

The slits or grooves 7, 8, 9, 12, 13, 14 are of circular-arc configuration so that they can be ground by cylindrical hollow grinding wheels.

From FIG. 3 it will also be apparent that the outwardly bent shank ends of a spring clip can also have an outward concavity, i.e. can correspond to a segment of an imaginary sphere 17 with a radius R. Thus the shank end has a circular curvature in longitudinal section and in a transverse section.

To allow the intrinsic elasticity of the shank end to stress the latter relative to the groove in which it is received, the inner radius r' of the groove is at least 0.5% smaller than the radius r of the free shank receivable in this groove or, stated otherwise, r is at least 0.5% larger than r'.

The radius R of the imaginary sphere, depending upon the size of the clip, will be at least 3 mm and at most 500 mm.

The sphere 22 is cut so that the free shank ends are straight, i.e. along a cutting circle of the sphere 22 having a radius r of at least 1 mm. This radius can range up to 90% of the radius of the imaginary sphere. The radius r is thus measured in a plane perpendicular to the first plane.

The widths of the spring clips 4, 5, 6, 15, 16, 18, 19, 20 should be at least 1 mm and a maximum of 30 mm while the height should be at least 3 mm.

The free ends of the spring clips penetrate at least 2% of the height of the spring clip into the hard-material plates but not more than 25% of the spring clips length. The major contribution to the anchorage of the spring clip in the hard-material body is the force generated by deformation, i.e. the force with which the shank presses on the walls of the groove. However, the ends of the clips can be soldered, welded, cemented, rigid or potted, e.g. with hardenable glass-fiber reinforced synthetic resin, in the grooves.

Because of the spheroidal configuration of the ends of the spring clips the material of the latter is stiffened and prevents withdrawal even after long term use because of material fatigue.

In plan view the grooves preferably have a crescent-moon shape whose widest and deepest point is along a median plane through the pair of grooves transverse to them, the narrowest and shallowest portions being at the ends of the crescent. This will be clearly apparent from FIGS. 7 through 9. FIG. 7 also shows inner radius r'.

I claim:

1. A connecting assembly for a hard-material member and a rigid support member in flat contact with one another along planar juxtaposed surfaces whereby the hard-material member of an oxide ceramic forms a support for a water-permeable layer for the dewatering of a pulpy mass, said assembly comprising in combination with said members, a plurality of U-shaped spring clips interconnecting same and bridging said surfaces, the bights of said clips being received in said rigid support member, the hard-material member being formed with circular-arc grooves opening inwardly from the respective one of said surfaces and formed in pairs, each of said clips having a pair of shank ends received in a respective pair of grooves each individual to one shank end and being of circular-arc curvature, each shank end being bent outwardly with a circular-arc curvature measured in a plane of a longitudinal dimension of the shank of radius R, each shank end further being bent transversely to its longitudinal dimension to be outwardly concave with a circular curvature of said radius R, the free edges of the ends of the shanks of the clips having radius r that is at least 0.5% greater than the inner radius r ' of the respective grooves whereby each of said ends bears upon the material of said hard-material member with the force of at least 1 g but not more than 5% of the rupture strength of the material of said hard-material member, said ends of the shanks of said clips conforming to spheroidal segments of an imaginary sphere having said radius R of at least 3 mm and up to a maximum of 500 mm, the free edges of said shanks lying along a cutting circle whose radius r is at least 1 mm and up to 90% of the radius R of the imaginary sphere.

2. The assembly defined in claim 1 wherein each of said clips has a width of at least 1 mm and a maximum of 30 mm.

3. The assembly defined in claim 2 wherein each of said clips has a height of at least 3 mm.

4. The assembly defined in claim 3 wherein free ends of the respective clips project beyond said surface of said rigid-support member into said hard-material member by at least 2% of the length of the respective clip but at most 25% of said length.

5. The assembly as defined in claim 1, further comprising means for bonding said shanks to said hard-material member in the respective grooves.

6. The assembly defined in claim 1 wherein said grooves have crescent-moon shapes at said surface of said hard-material member and are of greatest width and depth at their respective centers and are narrowest and shallowest at their respective ends.

7. A paper-making machine having a liquid-permeable layer for the dewatering of a pulpy mass and a drainage region across which said layer is displaced and formed with at least one assembly as defined in claim 1.

* * * * *

UNITED STATES PATENT AND TRADEMARK OFFICE

CERTIFICATE OF CORRECTION

PATENT NO. : 4,449,565

DATED : 22 May 1984

INVENTOR(S) : Heinrich Bartelmuss, et al.

It is certified that error appears in the above-identified patent and that said Letters Patent is hereby corrected as shown below: On the title page; left column, item [76] should read:

-- Inventor: Heinz Bartelmuss and Klaus Bartelmuss, both of No. 63, Steiermark, A-883 Teufenbach, Austria, legal representatives of Heinrich Bartelmuss, deceased, late of No. 63, Steiermark, A-883 Teufenbach, Austria --.

Signed and Sealed this

*Twentieth* Day of *August 1985*

[SEAL]

*Attest:*

DONALD J. QUIGG

*Attesting Officer* *Acting Commissioner of Patents and Trademarks*